US008056272B2

(12) United States Patent
Rosenzweig et al.

(10) Patent No.: US 8,056,272 B2
(45) Date of Patent: Nov. 15, 2011

(54) STEAM APPLIANCE WITH PUMP

(75) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 225 days.

(21) Appl. No.: 12/540,957

(22) Filed: Aug. 13, 2009

(65) Prior Publication Data

US 2010/0037495 A1 Feb. 18, 2010

Related U.S. Application Data

(60) Provisional application No. 61/088,766, filed on Aug. 14, 2008, provisional application No. 61/111,938, filed on Nov. 6, 2008.

(51) Int. Cl.
*D06F 75/22* (2006.01)
*D06F 75/38* (2006.01)
*D06F 75/36* (2006.01)

(52) U.S. Cl. ..... 38/77.8; 38/93

(58) Field of Classification Search .... 38/74, 77.7–77.9, 38/88, 93; 219/245, 248–250
See application file for complete search history.

(56) References Cited

U.S. PATENT DOCUMENTS

| | | | | |
|---|---|---|---|---|
| 2,749,633 | A * | 6/1956 | Seck | 38/77.7 |
| 3,050,885 | A * | 8/1962 | Whitfield | 38/79 |
| 3,074,192 | A * | 1/1963 | Smith | 38/93 |
| 4,577,424 | A * | 3/1986 | Liu | 38/88 |
| 4,837,952 | A * | 6/1989 | Hennuy et al. | 38/77.7 |
| 5,121,464 | A | 6/1992 | Hanada et al. | |
| 5,512,728 | A * | 4/1996 | Jalbert | 219/246 |
| 5,966,851 | A * | 10/1999 | Serpa | 38/79 |
| 6,453,587 | B1 | 9/2002 | Alipour | |
| 6,925,738 | B2 * | 8/2005 | Alipour | 38/79 |
| 2002/0020085 | A1 | 2/2002 | Kobayashi et al. | |
| 2005/0278987 | A1 * | 12/2005 | Ching et al. | 38/77.5 |
| 2008/0066789 | A1 | 3/2008 | Rosenzweig et al. | |
| 2008/0236635 | A1 | 10/2008 | Rosenzweig et al. | |

(Continued)

FOREIGN PATENT DOCUMENTS

| | | | |
|---|---|---|---|
| EP | 1801281 | A1 | 6/2007 |
| JP | 2006-255148 | A | 9/2006 |
| JP | 07313115 | A | 12/2007 |
| WO | WO 9849385 | A1 | 11/1998 |

(Continued)

OTHER PUBLICATIONS

International Search Report and Written Opinion for PCT/US2009/064401 mailed Apr. 21, 2010.

*Primary Examiner* — Ismael Izaguirre
(74) *Attorney, Agent, or Firm* — Wolf, Greenfield & Sacks, P.C.

(57) ABSTRACT

A steam appliance having a water pump controlled by an actuator or motion switch response to movement of the appliance is provided. In one embodiment, a micro-switch is turned ON and OFF by movement of a micro-switch actuator in operative engagement with the towel frame at the base if the appliance. In another embodiment, the actuator is operatively connected to a mechanical pump to activate the pump. The motor switch or actuator will be displaced whenever the unit is moved by a user, thus causing the pump to pump water to the boiler. Steam is then fed to a steam pad that may have a replaceable fabric pad fit snugly on the frame to distribute clean steam to a surface to be steamed.

18 Claims, 9 Drawing Sheets

U.S. PATENT DOCUMENTS

| | | | |
|---|---|---|---|
| 2009/0000051 | A1 | 1/2009 | Rosenzweig et al. |
| 2009/0223540 | A1 | 9/2009 | Rosenzweig et al. |
| 2010/0040489 | A1 | 2/2010 | Rosenzweig et al. |
| 2010/0088932 | A1 | 4/2010 | Rosenzweig et al. |
| 2010/0116298 | A1 | 5/2010 | Rosenzweig et al. |

FOREIGN PATENT DOCUMENTS

| | | | |
|---|---|---|---|
| WO | WO 0155496 | A2 | 8/2001 |
| WO | WO 2008016741 | A2 | 2/2008 |
| WO | WO 2008016761 | A2 | 2/2008 |
| WO | WO 2008/078867 | A1 | 7/2008 |

* cited by examiner

STEAM APPLIANCE WITH PUMP

CROSS REFERENCE TO RELATED APPLICATIONS

This application is based on and claims the benefit of U.S. provisional applications No. 61/088,766 filed on Aug. 14, 2008 and No. 61/111,938 filed on Nov. 6, 2008, the contents of which are incorporated herein by reference.

BACKGROUND OF THE INVENTION

The invention relates generally to a steam appliance, and more particularly to a steam appliance including a water pump that is user actuated by movement of the appliance to pump water from a water reservoir to a boiler for generating steam.

Steaming devices used to apply steam to household objects are well known. The uses of the devices vary widely, and may include the application of steam to drapes or other fabrics to ease wrinkles, and the application of steam to objects to assist in cleaning the various objects and surfaces.

In general, nozzles used with the steam appliances do not have large surface areas and a cloth or fabric pad is placed over a steam frame to provide a steaming or cleaning surface. The fabric pad may have Velcro strips to secure to cleats on the nozzle. Alternatively, a fabric steam pocket may be placed around a flat frame with baffles in order to increase the cleaning surface area.

Recently steam appliances have been developed where water is pumped from a reservoir to a boiler by the push-pull movement of the appliance handle. This actuates a bellows pump or piston pump operatively connected directly to the handle. These features are shown and described in parent applications Ser. No. 11/496,143 and Ser. No. 11/769,525, the contents of which are incorporated here by reference in their entirety.

Notwithstanding the wide variety of steam appliances available remains desirable to provide additional steam products having improved ease of use and ways to pump water from the reservoir to the steam boiler.

SUMMARY OF THE INVENTION

Generally speaking, in accordance with the invention, a steam appliance having a water pump for selectively injecting water from a water reservoir to a steam generator in response to a user action is provided. The user actuates the pump by movement of the appliance to activate a switch or a pump, in response to either a forward movement, a downward pressure or a backward movement. The steam appliance includes a housing with a user handle and a towel frame or cleaning pad where the generated steam is distributed for steaming. Water is pumped to the steam generator by an electric pump, a mechanical or systolic pump, or by mechanical movement of a pump piston or wheel. A steam frame for distributing steam generated in the steam generator may be connected the steam outlet of the appliance by an actuator or frame connector having a post extending into the housing that is displaced when the appliance is used to actuate the pump. Alternatively, the pump may be actuated in response to a user action that displaces the actuator or engages a trigger. A fabric steam pad may be mounted on the steam frame to distribute steam to the fabric to provide an improved steaming surface.

In one embodiment, the steam appliance has a bottom with a pump actuator forming at least a portion of a stream frame. In another embodiment, a steam frame is hinged and at another region is operatively connected to an actuator post. Movement of the appliance in contact with a surface displaces the steam frame and pump actuator to engage at least one micro-switch connected to an electric pump, or to operate a mechanical pump to pump water to the steam generator. In yet another embodiment, the pump is actuated in response to movement of the appliance that activates a motion switch.

Accordingly, it is an object of the invention to provide an improved steam appliance with respect to the following:

To provide an improved steam appliance having a steam generator wherein movement of the appliance causes water to be pumped to the steam generator for generating steam.

To provide a steam appliance with an actuator operatively coupled to a steam frame and at least one micro-switch to actuate a pump when the appliance is moved.

To provide a steam appliance that includes an actuator coupled to the steam frame that pumps water to a steam generator in response to movement of the actuator.

To provide a steam appliance with motor switch that is activated in response to movement the appliance causing water to be pumped to a steam generator.

Advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
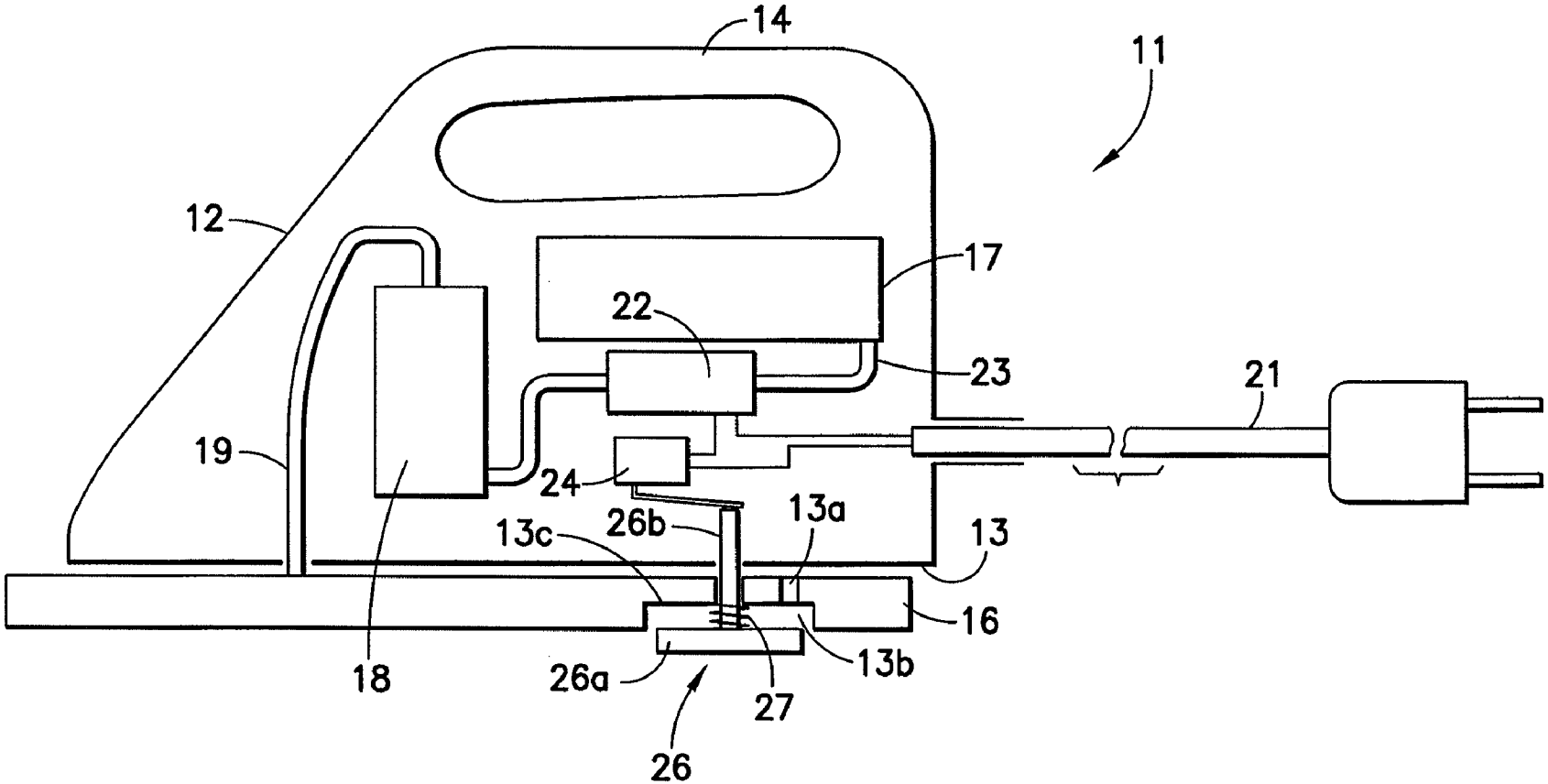
FIG. 1 is a schematic view of a steam appliance in section constructed and arranged in accordance with the invention with a handle and steam cleaning pad having an actuator section connected to a micro-switch for turning on a motor to operate a pump.

FIG. 1 is a schematic view of a steam appliance 11 constructed and arranged in accordance with the invention.

Appliance 11 includes a housing 12 having a base 13 and an upper handle 14. Base 13 includes a steam outlet opening 13*a*, an actuator opening 13*b*. A steam frame 16 is connected to base 13 and will accommodate a towel or fabric steam pocket for cleaning as is known in the art. Steam frame 16 is formed with an actuator depression 16*a*.

Appliance 11 includes internal elements similar to those in a steam mop and includes a water reservoir or tank 17 and a steam generator 18 with a steam hose 19 connected to steam frame 16. Appliance 11 is powered by household current by a power cord 21.

In this embodiment, water in reservoir 17 is fed to boiler 18 through an outlet hose 23 by a pump 22, which could be an electrical pump, a one-way tubular pump, or any conventional type of rotary electrical pump. Pump 22 in this embodiment is controlled by a micro-switch 24 which is actuated from ON to OFF and vice versa by a switch actuator 26. Micro-switch actuator 26 includes a disc portion 26*a* and a post 26*b* cooperating with steam frame 16 and actuator depression 16*a* to complete the surface area of steam frame 16. Actuator disc portion 26*a* forms a part of steam frame 16 and has a spring 27 that forces disc portion 26*a* to extend below the surface of steam frame 16. The force of spring 27 is adjusted so that it is sufficient to maintain actuator post 26*b* out of contact with micro-switch 24 when appliance 11 is not in use. This maintains micro-switch 24 in the OFF position at any time when appliance 11 is left unattended.

Once appliance 11 is taken by a user to start the cleaning steaming process, the weight of the user's hand and the force of pressure that user applies to appliance 11 is high enough to overcome the force of spring 27 and to force micro-switch actuator 26 inward and at the same time turn micro-switch 24 to the ON position. Turning micro-switch 24 to the ON position starts the water delivery to steam generator 18 by activating pump 22 causing water to be pumped to boiler 18 and the steam generation process to start. Steam generator 18 is maintained hot from the moment when power cord 21 of appliance 11 is plugged into a wall outlet to reduce delay time between uses.

Once the cleaning process is stopped and appliance 11 is left without any excessive weight, spring 27 disengages micro-switch actuator 26 causing switch 24 to be turned OFF. This interrupts water delivery to steam generator 18 and the steam generation process is stopped.

Figure 2:
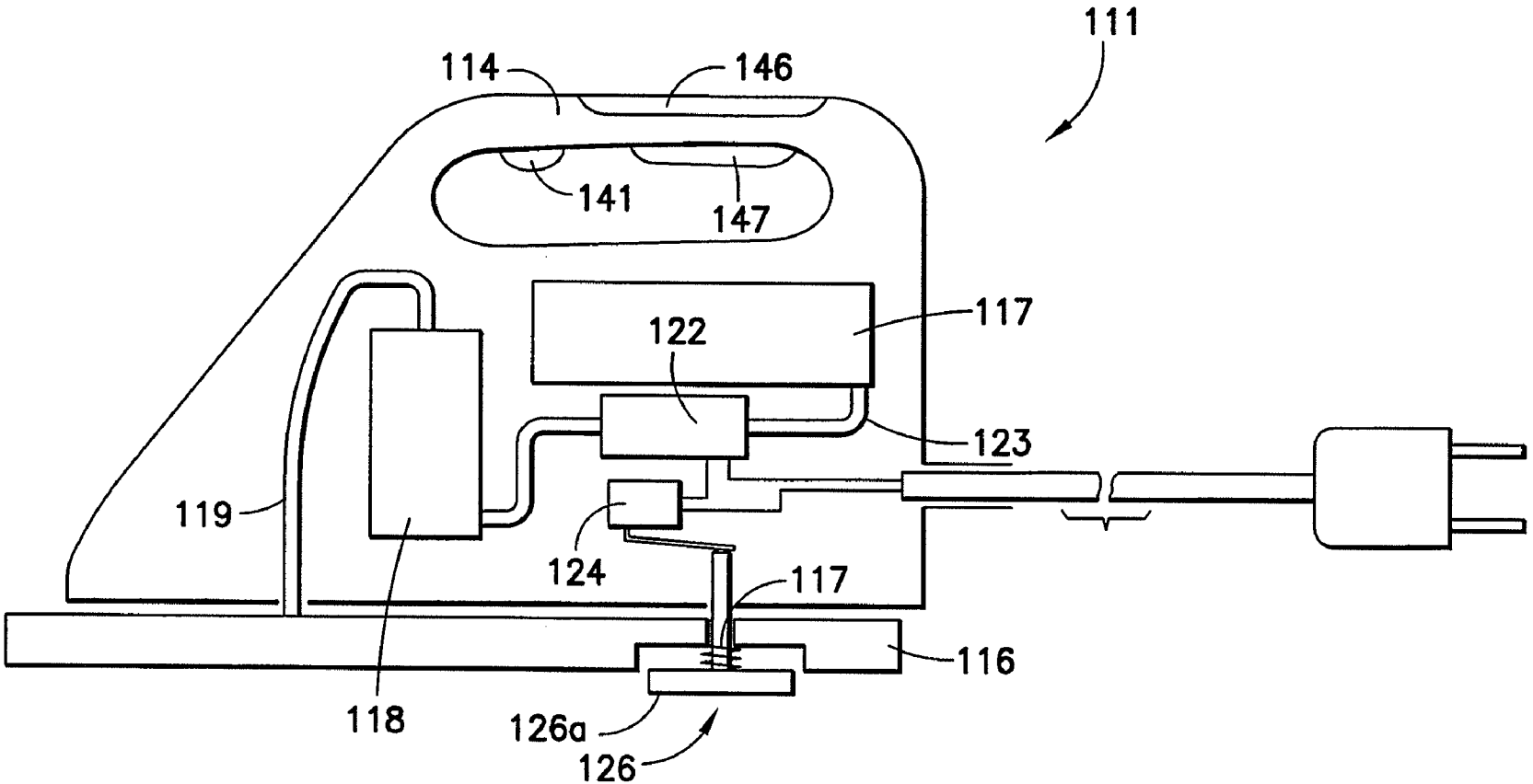
FIG. 2 is a schematic view of a steam appliance as in FIG. 1 with a trigger to actuate the pump.

FIG. 2 shows another steam appliance 111 constructed and arranged in accordance with another embodiment of the invention. All elements in FIG. 1 appearing in FIG. 2 are identical except for the addition of 100 to element numbers. Appliance 111 is identical to appliance 11, except it includes a trigger handle 114 with a trigger 141 to activate pump 122. In addition, steam appliance 111 may include a touch/contact switch or a pair of touch contacts 146 and 147 on handle 114.

In both configurations, water pump 122 will be activated (1) when pressure is applied downward on appliance 111 and micro-switch actuator 126 is displaced to activate micro-switch 124; (2) when a user activates trigger 141 with his hand; or (3) when a user touches handle 114 with his hand and activates touch contacts 146 and 147 to activate touch/contact switch Y.

Water in reservoir 117 is fed through an outlet hose 123 to boiler 118 by electrical pump 122 that can be a one-way tubular pump or any conventional type of rotary electrical pump. Pump 122 is controlled by micro-switch 124 which is actuated from ON to OFF and vice versa by a switch actuator 126. Disc portion 126*a* micro-switch actuator 126 forms part of steam frame 116 and is connected to a spring 127 that forces it to extend below the surface of steam frame 116. The force of spring 127 is adjusted so that it is sufficient to extend actuator 126 and at the same time turn micro-switch 124 to the OFF position at any time when appliance 111 is left unattended.

Figure 3:
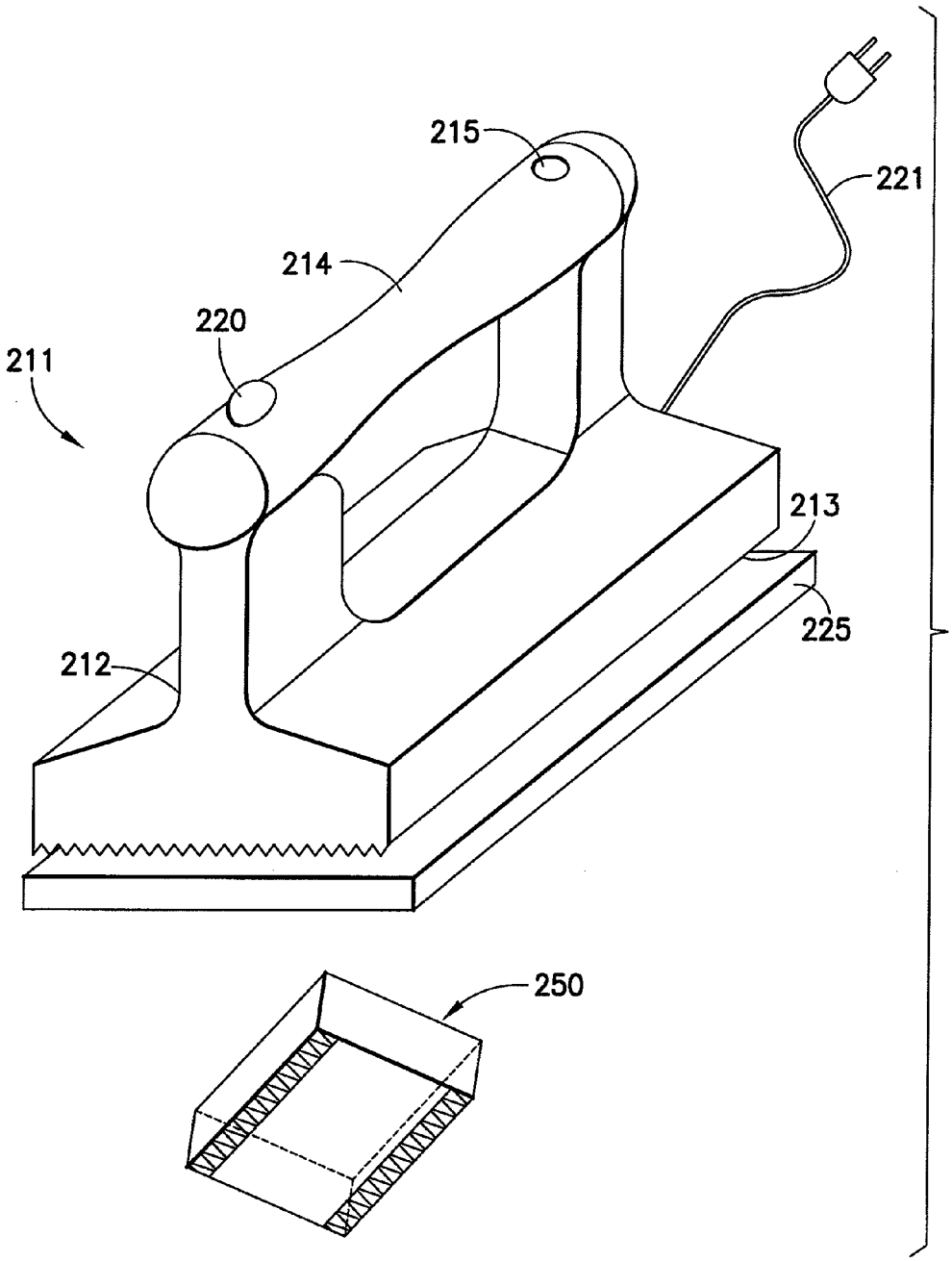
FIG. 3 is a perspective view of a steam appliance constructed and arranged in accordance with one embodiment of the invention.

FIG. 3 is a perspective view of a steam appliance 211 constructed and arranged in accordance with another embodiment of the invention. All elements in FIG. 1 appearing in FIG. 3 are identical and identified by numerals with the addition of 200 to element numbers. Here, steam appliance 211 includes housing 212 having an upper handle 214 with a water inlet 215 on one side of the handle and a recess 220 on the other side of the handle for attaching a pole to use brush 211 to hard to reach areas and a base 213. A towel frame 216 is connected to base 213 and will accommodate a towel 225 for cleaning as is known in the art. Steam appliance 211 also may include an upholstery glider 250 for securing towel 225 when cleaning upholstery.

Figure 4:
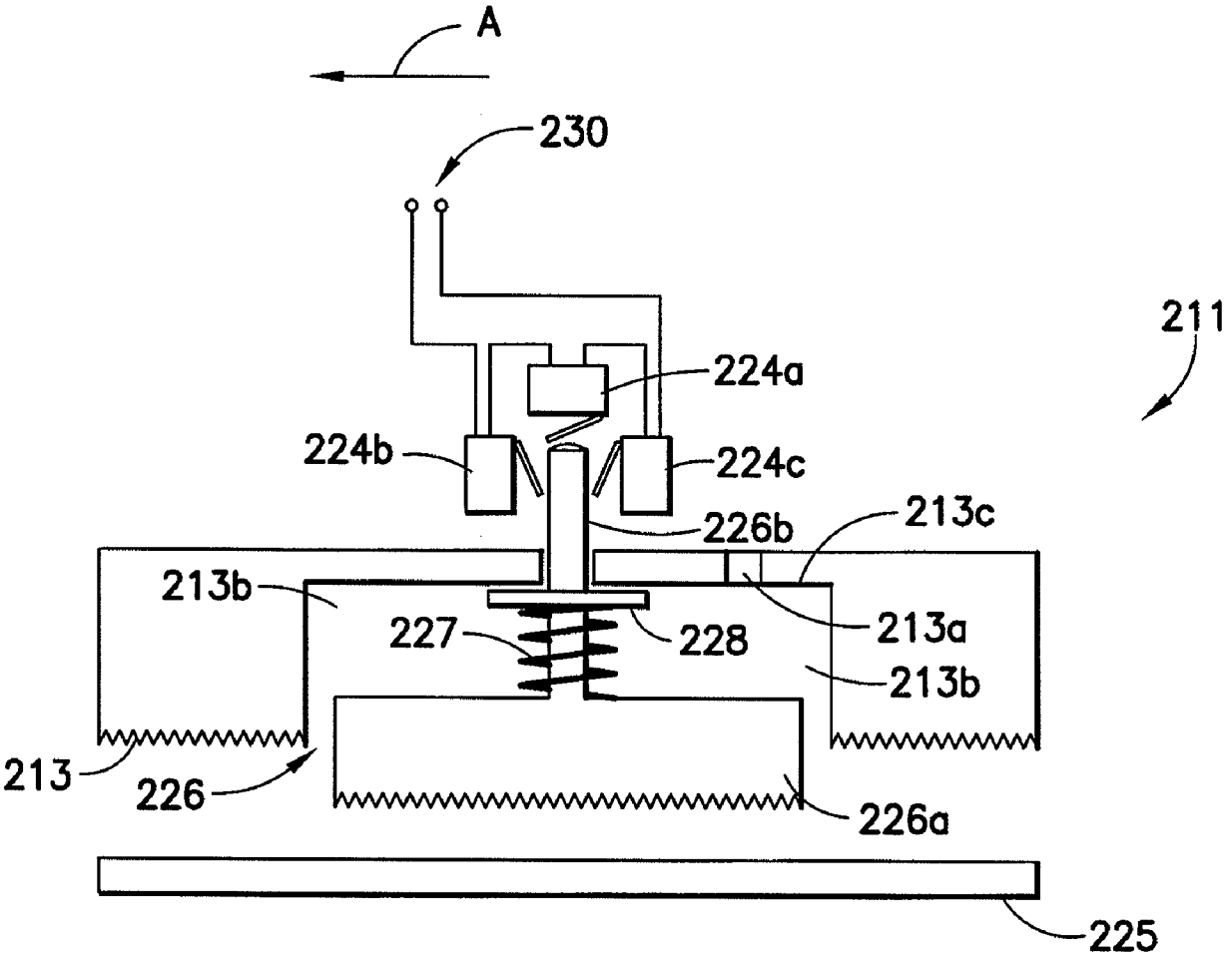
FIG. 4 is a schematic view of an actuator section and micro-switches for turning on a motor to operate a pump in the steam appliance of FIG. 1.
Figure 5:
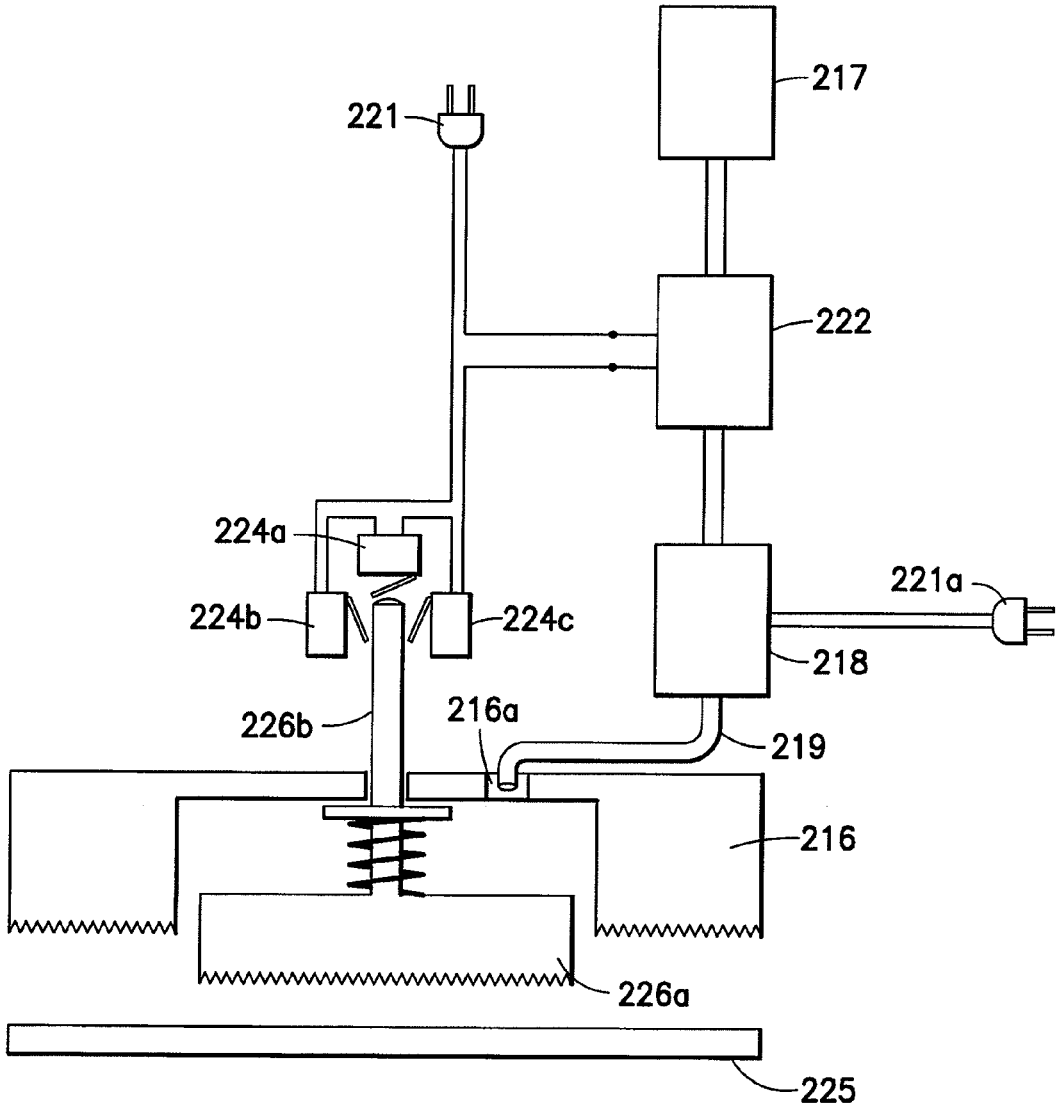
FIG. 5 is a schematic view of the electrical connection of the steam appliance of FIG. 3.

FIGS. 4 and 5 are sectional views of micro-switch 224 and actuator 226 assembly of steam appliance 211, respectively. Here, the activation of electrical water pump 222 corresponds to forward movement shown by arrow A, backward movement, and up or down pressure. Base 213 has a steam outlet opening, an actuator opening, and an actuator depression as in appliance 11 and 111 in FIGS. 1 and 2. Micro-switch actuator 226 has a planar or disc portion 226*a* and a post 226*b* that extends into appliance housing adjacent to micro-switches 224*a*, 224*b* and 224*c*. During forward movement, post 226*b* contacts micro-switch 224*c*. Disc section 213 is biased away from opening 213*b* by a spring 227 and a washer 228. In view of this, when brush 211 is at rest, pump 222 is maintained in the OFF condition.

Electric water pump 222 will be activated (1) when pressure is applied downward and micro-switch actuator 226 is displaced to activate micro-switch 224*a*; (2) when a user moves steam hand brush forward and micro-switch actuator 226 is displaced to activate micro-switch 224*c*; and/or (3) when a user moves steam hand brush backward and micro-switch actuator 226 is displaced to activate micro-switch 224*b*. Each or all of micro-switches 224*a*, 224*b*, and 224*c* will activate the water pump which will instantaneously pump water into a boiler 218 to create steam to clean surfaces. In another embodiment, water pump 222 may be a standard piston pump or systolic pump. An electrical connector 230 connected to power cord 221 is shown to provide power to water pump 222.

FIG. 5 shows the electrical connection of steam appliance 211 of FIG. 3. Here, brush 211 includes a water reservoir or tank 217 and boiler 218 with a steam hose 219 connected to towel frame 216 through steam opening 216*a*. Steam appliance 211 is powered by household current by two power supplies 221 and 221*a*. When power supply 221 or 221*a* is plugged in and when one or all of micro-switches 224*a*, 224*b*, and 224*c* are activated water pump 222 will pump water to boiler 218 to be discharged to steam inlet 219 and into towel 225 for cleaning surfaces.

Figure 6:
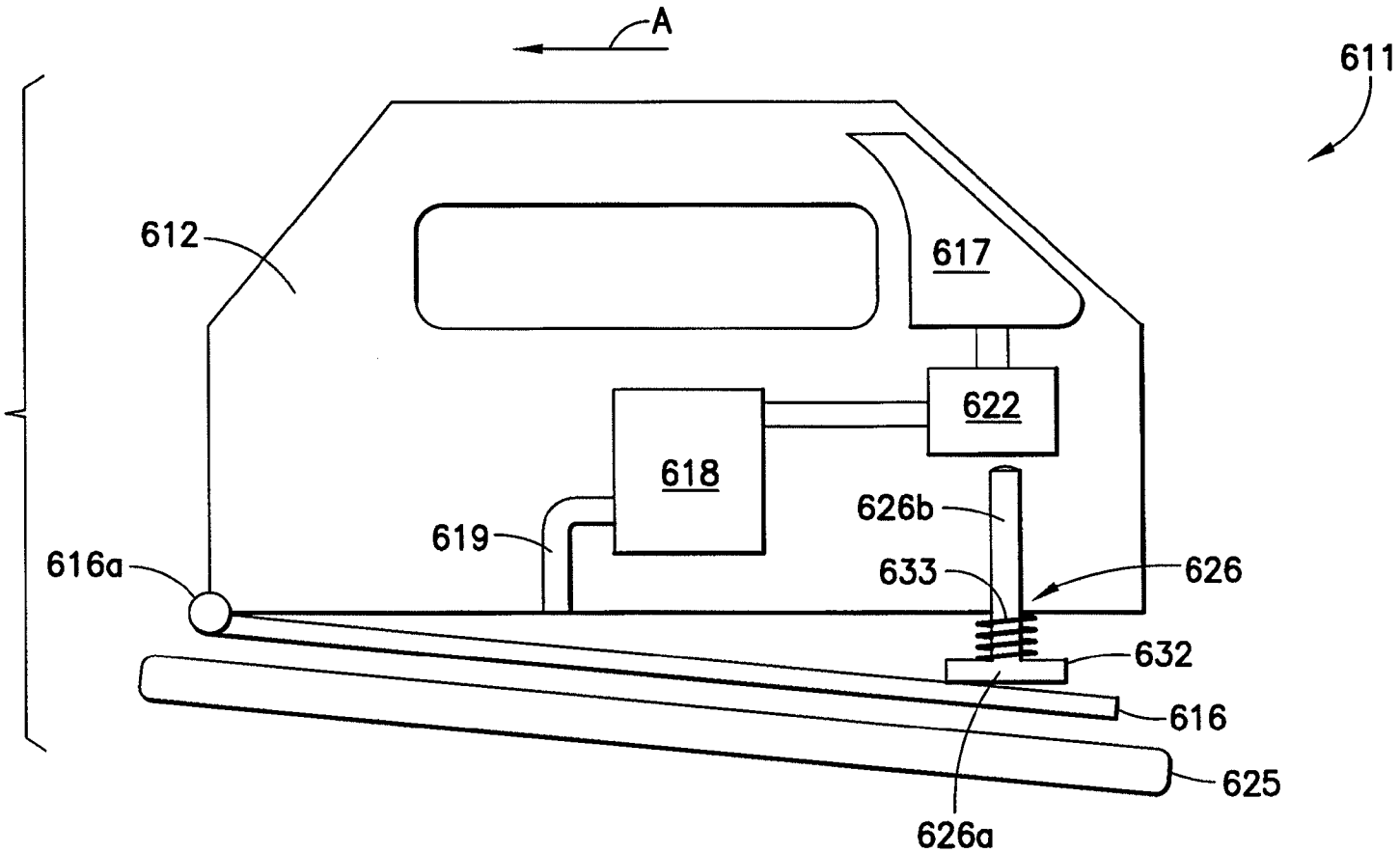
FIG. 6 is a schematic view of a steam appliance with a steam frame hinged to the base with an actuator positioned behind the steam frame.

In the embodiment illustrated in FIG. 6 a steam appliance 611 having an actuator 626 functions in the same manner as actuator 26 in steam appliance 11 of FIG. 1. Here, steam appliance 611 includes a housing 612 with a displaceable towel frame 616 hinged to the base of housing 612 by a hinge 616*a*. Towel frame 616 is contacted by actuator disc portion 626*a* of actuator 626 that is biased away from the base of housing 612 by a spring 633 as in steam appliance 611. The principal difference here is that actuator 626 rests on the rear side of steam frame 616 and does not protrude through base 616 as in steam appliance 11. This provides a smooth steaming surface when a steam towel or pad 625 is placed on steam frame 616.

As in connection with steam appliance 11, when a user moves steam appliance 611 in a forward direction shown by an arrow A, the downward force exerted on housing 612 causes steam frame 616 to pivot about hinge 616*a* and compress actuator spring 633 and actuator post 626*b* contacts micro-switch 624 causing pump 622 to pump water from reservoir 617 to generator 618. This generates steam fed to steam frame 616 through steam outlet 619.

Pump 622 is shown as an electrical pump actuated by micro-switch 624, but the pump can be a mechanical or systolic pump actuated when actuator post 626*b* is displaced by steam frame 616 being pivoted towards housing 612. Spring 633 is sufficiently strong to keep actuator shaft 626*b* from contacting micro-switch 624 wherein steam appliance 611 is placed in a resting position on steam frame 616. In this instance, steam will not be generated when steam appliance 611 is at rest.

Figure 7:
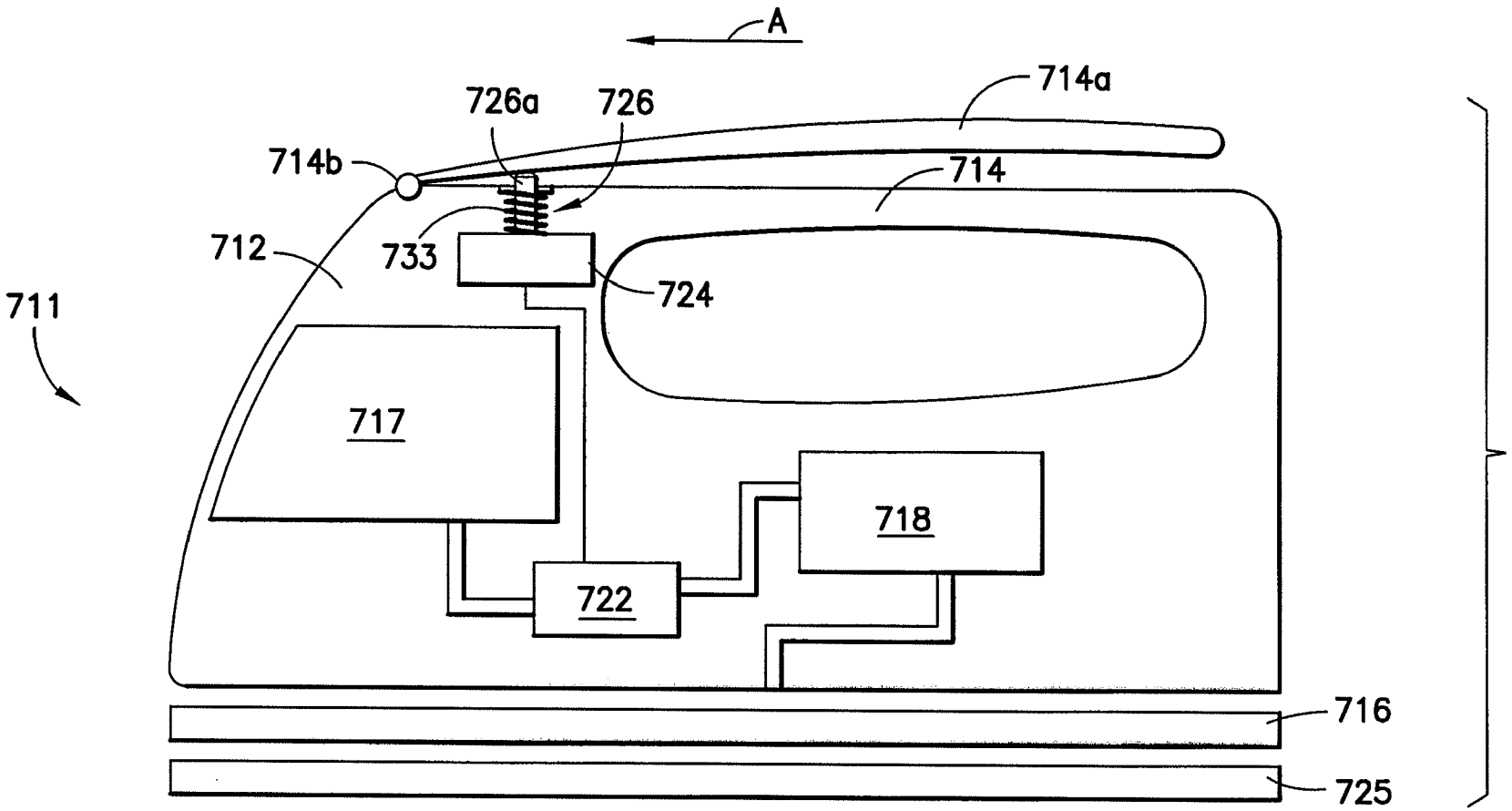
FIG. 7 is a schematic view of a steam appliance with an electrical pump micro-switch actuator positioned behind a handle lever in accordance with an embodiment of the invention.

A steam appliance 711 in FIG. 7 constructed in the same manner as the earlier embodiments has an actuator 726 positioned at the top of a housing 712 with an actuator post 726*a* operatively engaged with a pivoting handle extension 714*a* mounted on housing 712 by a hinge 714*b*. Steam appliance 711 includes a steam frame 716 for mounting a steam towel or pad 725. Here, when a user moves steam appliance 711 in forward direction A, handle extension 714*a* pivots about hinge 714*b* and presses on actuator 726 overcoming the force of spring 733 and post 726*b* contacts micro-switch 724. This causes pump 722 to be actuated and water to be pumped from water tank 717 to steam generator 718 for feeding steam to steam frame 716.

Figure 8:
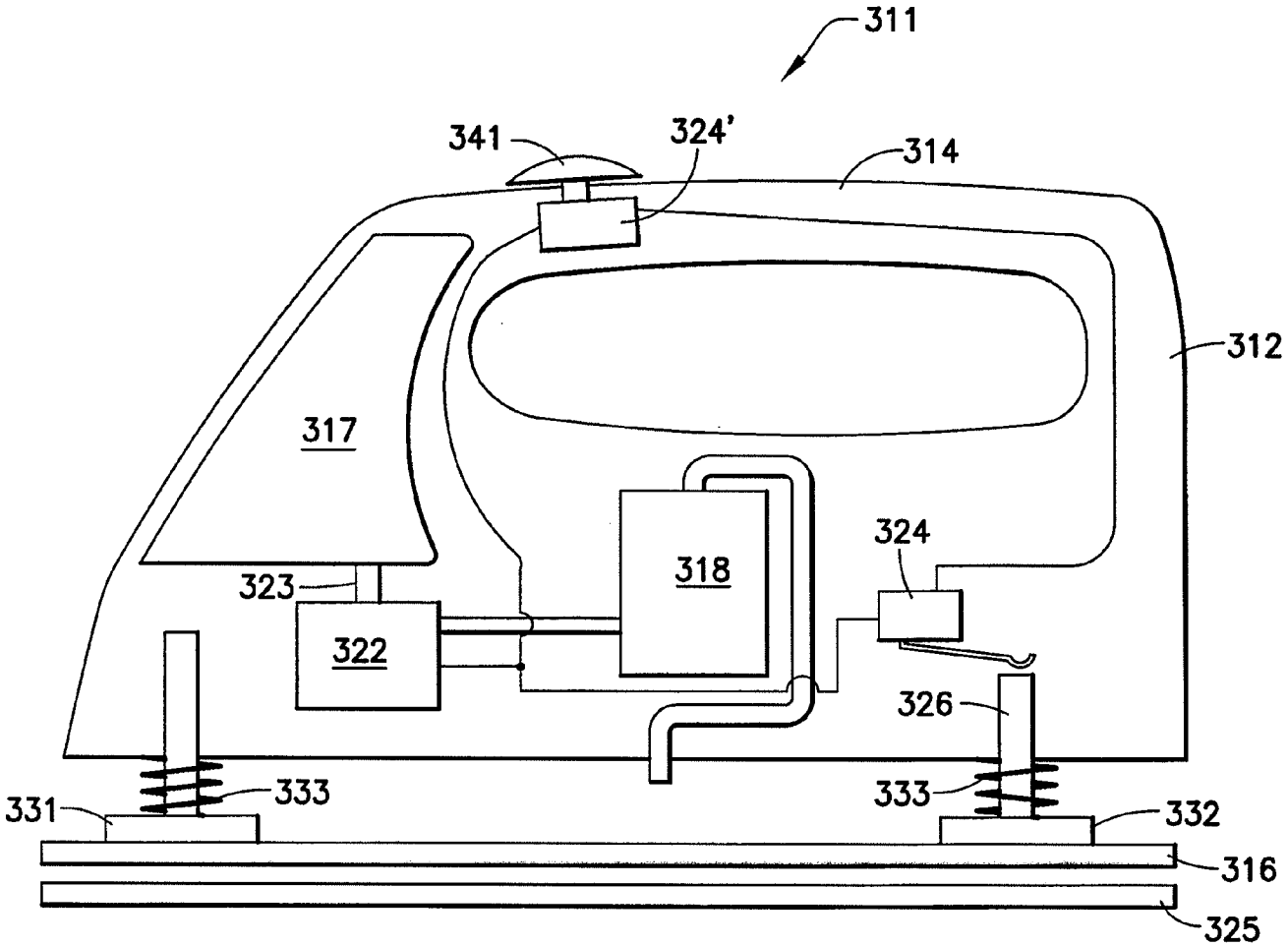
FIG. 8 is a schematic view of a steam appliance with a mechanical pump in section with a handle and steam cleaning pad attached to two steam frame supports with one support operatively connected to a micro-switch in accordance with one embodiment of the invention.

FIG. 8 is a schematic view of the elements of a steam appliance 311 that include an electrical pump 322 with a steam frame 316. All elements in FIG. 1 appearing in FIG. 8 are identical and identified by element numbers with the addition of 300 to the element numbers. Towel frame 316 is attached to housing 312 by a pair of frame supports 331 and 332 with springs 333 that keep micro-switch pump 324 in an OFF position when at rest.

Here, frame support 332 has micro-switch actuator post 326. Once steam appliance 311 is moved in any direction by a user to start the cleaning process, the weight of the user's hand and the force of pressure that user applies to steam appliance 311 is high enough to overcome the force of spring 333 and to force steam frame 316 inward. This in turn forces frame support 332 inward with post 326 contacting micro-switch 324 and placing it in the ON position. Turning micro-switch 324 ON starts the water delivery to steam generator 318 by activating pump 322 causing water to be pumped to boiler 318 and the steam generation process starts. Steam generator 318 is maintained hot from the moment when steam appliance 311 is plugged into a wall outlet to reduce delay time between uses.

Once the cleaning process is stopped and steam appliance 311 is left without any excessive weight, spring 333 extracts frame support 326 causing it to be turned OFF. This interrupts water delivery into steam generator 318 and the steam generation process is stopped.

Steam appliance 311 also includes handle 314 with a trigger 341 to activate pump 322 by a second micro-switch 324'. Thus, electrical pump 322 is activated (1) when pressure is applied downward and a frame support 332 is displaced to activate micro-switch 324' or (2) when a user activates trigger 341 by moving steam appliance 311 to activate micro-switch 324. Micro-switches 324 and 324' will activate mechanical water pump 322 which will pump water into a boiler 318 to create steam to clean surfaces.

Figure 9:
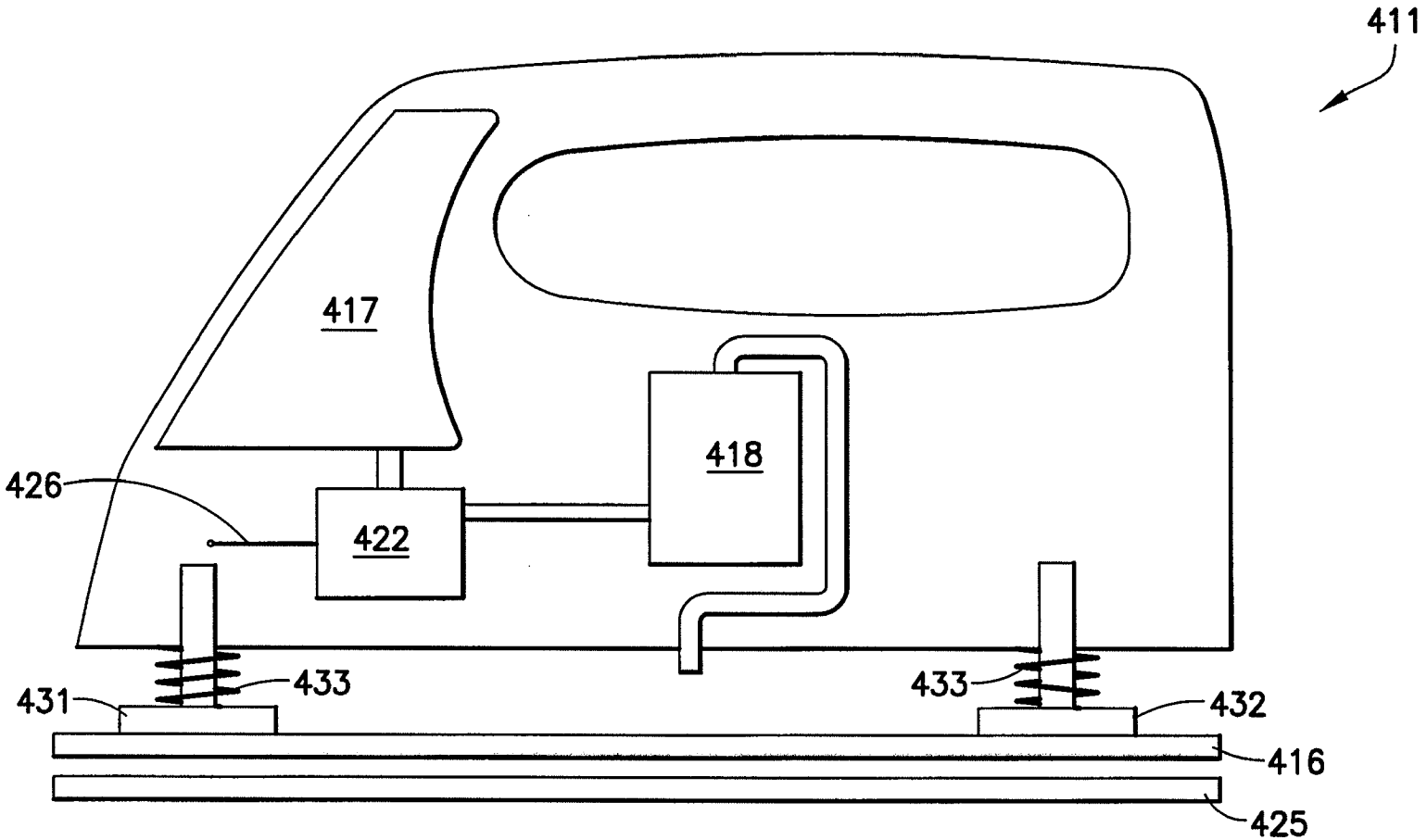
FIG. 9 is a schematic view of a steam brush with a mechanical pump and actuator in accordance with the invention.

FIG. 9 is a schematic view of a steam appliance 411 that includes a mechanical pump 422 and an actuator 426. All elements in FIG. 9 are identical to steam appliance 311 in FIG. 8 except for the addition of 100 to the reference numerals. Towel frame 416 is attached to housing 412 by a pair of frame supports 431 and 432 with springs 433 as in steam appliance 311 of FIG. 8.

Once steam appliance 411 is taken by a user to start the cleaning process, the weight of the user's hand and the force of pressure that user applies to steam appliance 411 is high enough to overcome the force of spring 433 and to force towel frame 416 inward which in turn forces slider 431 inward to activate an actuator 426 of a mechanical pump 422 causing water to be pumped to boiler 418 and the steam generation process starts. Steam generator 418 is maintained hot from the moment when steam appliance 411 is plugged into a wall outlet to reduce delay time between uses.

When the cleaning process is stopped and steam appliance 411 is left without any excessive weight, spring 433 extracts frame support 431 to stop pumping mechanical pump 422 to boiler 418. This interrupts water delivery into steam generator 418 and the steam generation process is stopped. Mechanical pumps of the type shown in U.S. applications Ser. No. 11/496,143 and Ser. No. 11/769,521 are suitable to use in steam appliances 11, 311, 411 and 711. Tubular pumps of the type shown in U.S. application Ser. No. 12/421,261 are also suitable for use. The contents of these applications are incorporated wherein by reference in their entirety.

Steam appliances 11, 111, 211, 311, 411, 611 and 711 provide many advantages for ease of use because they utilize either an electrical or mechanical water pump with an automatic on/off switch to activate the water pump. In all the appliances, displacement of actuator 26, 126, 226, 326, 426, 626 or 726 allows the user control over when water is to be discharged into the boiler. Since the amount of water routed to the boiler is controlled, the boiler can create steam in a short amount of time. In each case, a fabric steam pad frame is typically placed over steam frame 16, 116, 216, 316, 416 616, or 716 for effective steam cleaning.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A steam appliance, comprising:

a housing having a steam outlet opening and an actuator opening;

a water reservoir in the housing having a water inlet and water outlet;

a pump connected to the outlet of the water reservoir and to a water inlet of a steam generator;

a steam frame connected to the outlet of the steam generator;

an actuator for actuating the pump to pump water to the steam generator in response to movement of the appliance, the actuator extending from the steam frame into the housing, whereby the actuator is displaced when the appliance is moved;

the movement of the actuator activates the pump to pump water to the steam generator.

2. The steam appliance of claim 1 further comprising:

an electrical pump to pump water from the reservoir to the steam generator; and at least one pump micro-switch connected to the electric pump and operatively connected to the portion of the actuator that extends into the housing.

3. The steam appliance of claim 1 wherein the pump actuator extending in the housing forms a part of the steam frame and has a post portion operatively connectable to the at least one micro-switch.

4. The steam appliance of claim 3, including three micro-switches to activate the pump wherein movement of the post portion of the actuator in response to either a forward movement, a downward pressure or a backward movement of the appliance.

5. The steam appliance of claim 3, wherein the pump actuator is biased away from the at least one micro-switch.

6. The steam appliance of claim 1, wherein the steam appliance is a hand-held steam brush including a user handle.

7. The steam appliance of claim 6, wherein the handle includes a trigger to close the at least one micro-switch to activate the pump.

8. The steam appliance of claim 1, further including a fabric steam pad for distributing steam.

9. The steam appliance of claim 1, wherein the actuator contacts the frame and is displaced in response to movement of the frame relevant to the housing.

10. The steam appliance of claim 9, with the actuator opening in the housing and the actuator has a first end contacting the frame and an elongated post extending into the housing with the first end biased away from the housing; and the steam frame connected to the housing at at least a first region and contacting the contact surface of the actuator at a second region; and wherein movement of the appliance displaces the second region of the steam frame towards the housing to move the pump actuator and pump water to the steam generator.

11. The steam appliance of claim 10, including an electric pump and a micro-switch connected thereto, and wherein the actuator contacts the micro-switch when the appliance is moved.

12. The steam appliance of claim 1, including:

the steam frame for distributing steam generated mounted to the bottom of the housing by two frame supports and having a portion of at least one support extending into the housing; and at least one of the frame supports being a pump actuator with a post that activates the pump when the appliance is moved and the actuator is displaced towards the housing.

13. The steam appliance of claim 12, wherein the frame is biased away from the housing.

14. The steam appliance of claim 13, further including an electric pump and at least one micro-switch operatively connected to the pump and displacement of the handle lever displaces the actuator to contact the micro-switch to activate the pump.

15. The steam appliance of claim 13, wherein the pump is a mechanical pump and the post of the frame support is operatively connected to the pump and displacement of the steam frame displaces the post to operate the pump.

16. The steam appliance of claim 6, wherein the handle includes a handle lever portion pivotally connected to the housing and contacting the pump actuator so that any movement of the handle lever towards the housing displaces the actuator to activate the pump.

17. The steam appliance of claim 16, wherein the pump is a mechanical pump activated by movement of the actuator.

18. The steam appliance of claim 16, further including an electric pump and at least one micro-switch operatively connected to the pump and displacement of the handle lever displaces the actuator to contact the micro-switch to activate the pump.

* * * * *